United States Patent [19]

Ragot

[11] 4,433,444

[45] Feb. 28, 1984

[54] TOILET WITH MECHANICAL DRAINAGE COMPRISING A DRAINING CHAMBER ACCESSIBLE AND DISMOUNTABLE FROM INSIDE THE TOILET BOWL

[76] Inventor: Claude Ragot, Place du 11 Novembre, 56500 - Locmine, France

[21] Appl. No.: 373,140

[22] Filed: Apr. 29, 1982

[30] Foreign Application Priority Data

May 8, 1981 [FR] France ..... 81 09212

[51] Int. Cl.[3] ..... E03D 9/10

[52] U.S. Cl. ..... 4/319; 4/420; 241/285 R; 241/46.11

[58] Field of Search ..... 4/300, 319, 320, 321, 4/420, 431, DIG. 4; 241/285 A, 285 R, 46.11, 46.08

[56] References Cited

U.S. PATENT DOCUMENTS 2,779,948 2/1957 Houle ..... 4/319

3,491,379 1/1970 Parrish ..... 4/320

4,271,540 6/1981 Clifton ..... 4/319

*Primary Examiner*—Stephen Marcus

*Assistant Examiner*—Kenneth S. Putnam

*Attorney, Agent, or Firm*—Fisher, Christen & Sabol

[57] ABSTRACT

The invention relates to a toilet apparatus with forcible drainage.

Said toilet is of the type comprising a bowl supplied with water and communicating through its bottom part with a lower chamber equipped with means for crushing the faeces and removing them towards a draining conduit. Said toilet being characterized in that the crushing and draining means are designed to be removable, thus permitting the dismantling of the crushing means from the bottom part of the bowl. The invention finds application in toilet apparatus permitting the ready dismantling and cleaning of the crushing and draining members.

9 Claims, 3 Drawing Figures

TOILET WITH MECHANICAL DRAINAGE COMPRISING A DRAINING CHAMBER ACCESSIBLE AND DISMOUNTABLE FROM INSIDE THE TOILET BOWL

BACKGROUND OF THE INVENTION

1. Field of the Invention

The present invention relates to a toilet of the type with a crushing member and comprising a crushing chamber communicating with the bottom of the toilet bowl, said chamber comprising means, such as a rotor, causing on the one hand, the reduction of the faeces to be evacuated and which are in suspension in the water, and on the other hand their circular movement, so that a centrifugal pump effect can suspend and remove faeces with the water towards the outside.

2. Description of the Prior Art

Such toilets with forcible drainage of this type have many advantages; for virtually nil energy consumption, they enable one to install a toilet, complete with seat, in places which are not connected with a mains sewerage system.

The faeces in suspension in the water being propelled mechanically, enable these toilets to be installed at a low level, for example in a cellar or in places where the drain needs to be raised to go over a threshold, or where the sanitary point is far from the draining point.

Moreover, installations of this type require a reduced water consumption compared with toilet installations with flushing systems.

The devices with crushing members however often show some disadvantages when as is often the case, the users use the sanitary installations to get rid of non-crushable matters.

This occurs in particular in public places, hotels, and the like, where a user, just passing through and being either unreasonable or ignorant of the special conditions of use of drains with crushing members, tries to rid himself of all types of articles which are often badly "digested" by the installations.

Accidents are known to occur, such as for example the frequent jamming up of the rotor, or the breakage of certain parts thereof; it also happens that foreign pieces or substances which have been drained out by the crushing member into the main drain, are wedged in a bent or narrower part of the drain causing blockage of the latter, such an accident being all the more difficult to repair that it is virtually impossible to find out what part the drain is actually blocked up.

In the less serious case of blockage at the level of the crushing member, the repair still remains delicate since it requires the dismantling of the crushing member which is situated under the bowl or at the back thereof, resulting in difficult access.

In these conditions, the known devices of which the object is to prevent foreign articles from being carried into a drain pipe of small diameter, and which are, for example, constituted of a filtering basket situated inside the crushing chamber and allowing the crushed matter through but stopping all hard or foreign substances, are not really satisfactory. Whenever a user throws a hard object into the bowl, it is necessary to dismantle the whole crushing member, from the rear face and lower part of the bowl, in order to reach the crushing chamber and to remove said article from said basket.

It is the object of the present invention to eliminate these drawbacks and to ensure a perfectly efficient operation of the draining device of the toilet bowl by way of forcible draining for example by way of a crushing member.

SUMMARY OF THE INVENTION

The invention prevents any objects liable to create an obstruction in the drain pipe from being carried into said pipe. In the case where such an object has been thrown into the bowl and remains in the crushing chamber, the invention makes it possible to remove it immediately without any difficulty, thus eliminating the long, tedious and delicate dismantling operation.

To this effect the invention relates to a toilet of the type constituted by a water-supplied bowl, of which the bottom communicates via a passage with a lower chamber provided with removable means for crushing the faeces and removing them towards a drain pipe. The crushing and draining means, and the passage between the bowl and the said crushing chamber, are so shaped and dimensioned that the crushing and draining means can be removed through the bottom of the bowl through the passage, thus giving access to the crushing and draining means from the bottom of the bowl and permitting the dismantling, removing and re-assembling thereof, through the open face of the bowl.

Preferably, the passage between the bowl and the lower chamber or crushing chamber is partly closed whilst in operation, by a removable closing wall which can be locked in position on the bottom of the bowl, said wall being provided substantially in its center with an opening of limited diameter to allow the removal of the draining water and of the faeces from the space inside the bowl towards the crushing chamber.

The invention will be more readily understood on reading the following description of a special embodiment given by way of example and non-restrictively with reference to the accompanying drawings.

DESCRIPTION OF THE PREFERRED EMBODIMENTS

Figure 1:
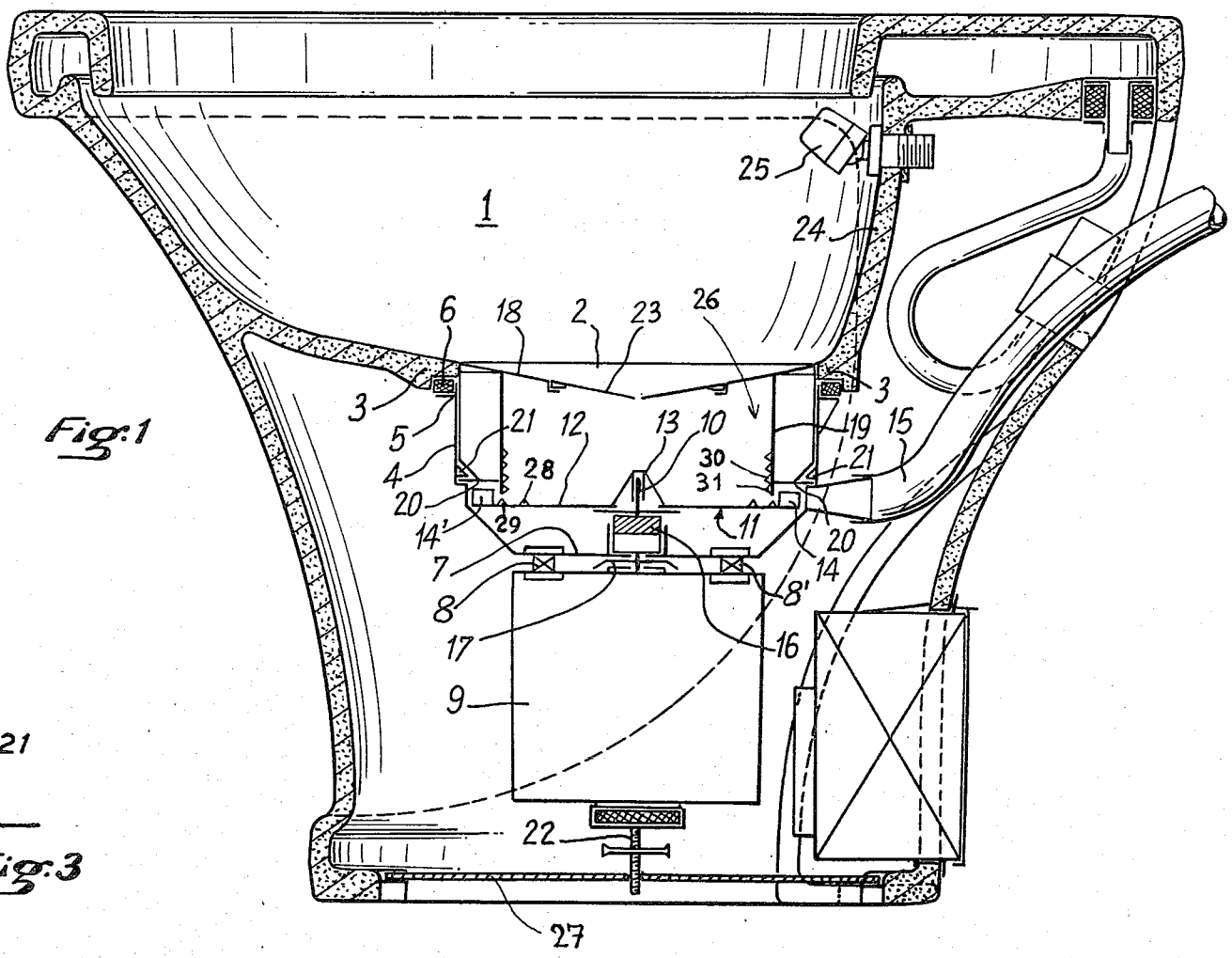
FIG. 1 is a longitudinal section of the toilet bowl and associated crushing member according to the invention, and FIG. 2 in a plan view of said bowl.
Figure 3:
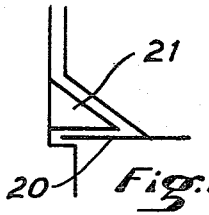
FIG. 3 is an expanded longitudinal section of members 20 and 21.
Figure 2:
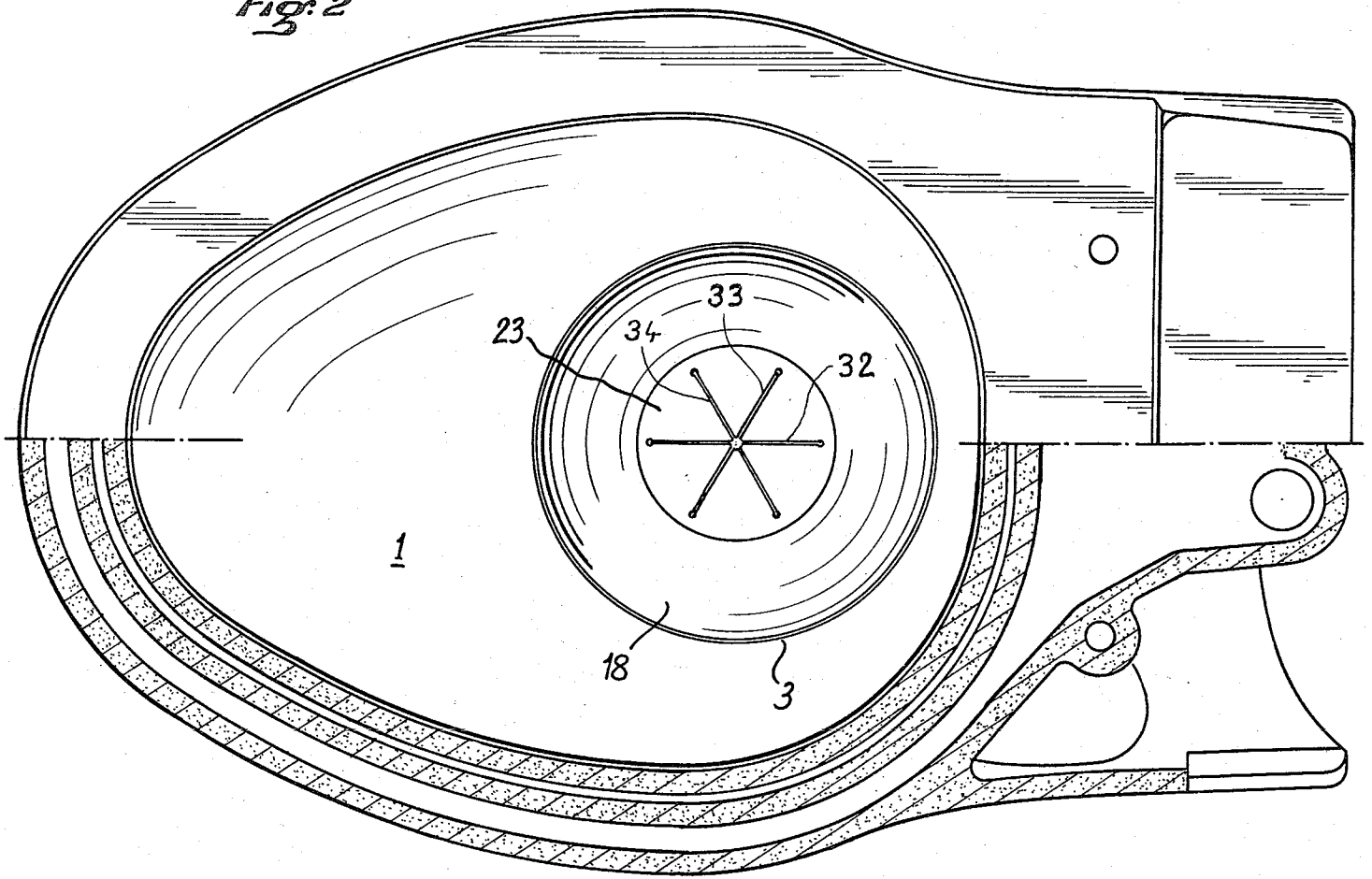

Said figures show that the toilet seat comprises a bowl 1 supplied with water by any suitable means.

The bowl is of conventional design externally; a gap 2 defined by the edges 3 of circular outline is provided on its bottom part.

Said gap 2 occupies a diameter substantially equal to half the length of said bowl. As this value is not characteristic, it remains necessary for the gap to allow, as will be explained hereinafter, the passage and removal of the crushing and draining means from inside the bowl, for maintenance purposes, and for dealing with any of the accidents describes hereinabove, for example removing hard objects which have gone through the crushing and draining chamber.

Under the lower wall of the bowl 1 and immediately below the edges 3 of the gap 2 there is provided a casing 4 of general cylindrical shape, the upper vertical edges 5 of which fit immediately below the edges 3 of the gap of the bowl, a seal 6 being inserted therebetween.

Said casing 4 which is open at its upper part constitutes and defines the crushing chamber 26.

The bottom 7 of said casing is secured by way of a nut and bolt system 8,8' to the electric motor 9.

The driving spindle 10, issued from the motor 9 traverses the bottom part 7 of the casing 4 and projects into the crushing chamber to receive the rotor 11.

Said rotor 11 is constituted by a disk 12 of which the center is associated with an overturned bowl, the open side facing downwards and said bowl 13 is adapted to fit on the pivot constituted by the end of the rotating spindle 10.

The disk 12 is provided on its periphery with radial vanes 14 and 14' of a known type permitting rotation of all the fluid contained inside the crushing chamber and its removal through the conduit 15 tangentially connected to the base of the crushing chamber, in known manner.

Known sealing means 16 are provided on the rotating spindle 10 to avoid any leaks of liquid from the crushing chamber 26 towards the motor under the bottom 7 of the casing. On the spindle 10, is interposed a washer or protection disk 17, permanently mounted on the spindle 10, and preventing any liquid from flowing along the spindle, upon rotation of the motor, when the apparatus is in use, projecting outwardly the few drops which may have accidentally infiltrated from the bottom of the casing and along the spindle 10.

The gap 2 through which the bowl 1 communicates with the crushing chamber 26 (constituted by the casing 4) is occupied, during operation, by a partially closing wall 18 (interrupted in its center by a set of radial slots 32, 33, 34) which is secured to the vertical skirt 19 penetrating into the crushing chamber substantially up to the level of the disk 12.

Said skirt 19 and disk 12 are perforated by slashes made into the preferably metallic wall of the skirt and disk respectively, and said slashes 28,29,30,31 are bent inwardly from the chamber; said slashes constituting, on the one hand, asperities which help to reduce and lacerate the faeces driven in rotation in the crushing chamber and consequently projected against the wall of the skirt, the whole assembly thus forming a rasp, and said slashes defining, on the other hand, openings of predetermined size, allowing the passage of the water containing the faeces in suspension, whilst opposing the passage from inside the chamber towards the drain pipe 15 of any hard objects which could block up the draining conduit 15.

Thus, the disk 12 and skirt 19 form on the one hand a rasp making the crushing operation particularly fast and efficient and on the other hand define a filtering basket or grid preventing redundant objects from passing through.

The assembly consisting of the partly closing wall 18 and skirt 19 is removably inserted in the casing 4 constituting the crushing chamber and can be secured in position for example by inserting radial blades 20 under the abutments 21, said assembly defining a removable fitting system of the bayonet type.

It is thus particularly easy to release the assembly formed by the skirt 19 and partly closing wall 18 by a simple pivoting and lifting out movement.

The inside of the crushing chamber becomes accessible, thereby permitting the removal of any foreign articles which may have slipped in or been inadvertently thrown into the bowl 1.

Likewise, by removing the skirt 19 and the partly closing wall 18, it becomes possible to remove, still by lifting vertically, the assembly consisting of the rotor 11 fitted onto spindle 10.

This allows a rapid cleaning operation whenever necessary, a few minutes being sufficient to remove and replace the two crushing and draining members, namely the fixed skirt 19 and the rotor 11.

Advantageously, the central opening provided on the partly closing wall 18 and through which the bottom of the bowl communicates with the crushing chamber 26, can also be partly closed off, when said wall 18 and skirt 19 are in the working position, by means of a diaphragm of a known type. The diaphragm is made of a supple material such as rubber, with radial slots joining up in their center, the whole assembly forming V-shaped lips capable of moving apart under the dynamic pressure of the fluid when said fluid is driven by the rotor, and returning immediately after to a closed position.

Besides the advantageous design which this diaphragm confers to the whole assembly, the presence of this supple closing diaphragm prevents any accidental interfering projection when the rotor is in operation.

It plays a protective part by avoiding any attempt at penetration, manual for example, when the assembly is in operation.

Experiments have also proved that this supple diaphragm plays an important part as a noiseless screen, so that the assembly works particularly silently. The sound vibrations which are linked to the rotation of the fluid medium in the crushing chamber and to its drainage through the drain pipe 15 are dampened by the presence of the supple diaphragm. When the lips of the diaphragm are open, they are under pressure of the fluid so that the space between the lips open downwardly, and is occupied by the liquid medium which is being removed. The assembly thus constitutes a solid and liquid screen which prevents the passage of sound vibrations and permits a particularly silent operation of the apparatus.

In known manner, the water supply is obtained by an electrovalve which operates in combination with the motor.

Therefore, the arrival of water precedes the starting up of the rotor and extends beyond the turning off of the rotor so that a certain quantity of water remains at the bottom of the bowl.

The assembly consisting of the casing 4 and of the motor 9 can be secured in position by any means. In the illustrated example, said assembly is secured by means of a lower lockscrew 22 forming a height-adjusting jack, the tightening of which pushes the motor upwards, said motor in turn pushing up the casing which as a result abuts against the edges 3 of the bottom of the bowl keeping pressure on the seals 6.

If necessary, it is easy to untightening screw 22 to release the assembly.

The bowl thus produced being obturated by the wall 18 and by the diaphragm 23 presents a bottom forming basin. The bowl can be used as a bidet; and to effect this the substantially vertical bottom 24 of the bowl can be provided with a nozzle which may be directionally-adjustable giving a directional spray of water for private hygiene.

In the illustrated example according to the invention, the motor is secured to the base of the assembly, and access to the crushing chamber is possible by removing the skirt 19 and the partly closing wall 18. It is obvious that, without departing from the scope of the invention, the bowl, crushing chamber and motor can be produced as a removable unit, which is introduced into a container (with conical or cylindrical wall) by its upper opening, said container being then integral with the base 27. This particular arrangement gives an even easier access in particular to the motor.

I claim:

1. A toilet of the type comprising a bowl supplied with water and of which the bottom part communicates via a passage with a lower chamber provided with means for crushing and draining faeces towards a downstream draining conduit, wherein the crushing and draining means is removably fastened within said lower chamber and said passage is so shaped and dimensioned so that the crushing and draining means can be removed from the lower chamber through said passage, thus giving access to said crushing and draining means from bottom of the bowl and permitting removing and re-assembling of said crushing and draining means through the bowl.

2. A toilet as claimed in claim 1, wherein said crushing and draining means have the shape of a circular body and the passage is circular, wherein the maximum diameter of said crushing and draining means is less than the diameter of the passage, thus permitting removal of said means through said passage through the inside of the bowl.

3. A toilet as claimed in claim 1, wherein the passage between the bowl and the lower chamber is partly closed in the operating position by a removable closing wall which can be locked in position on the bottom part of the bowl, said wall being provided substantially in its center with an opening of limited diameter to allow the removal of the draining water and of the faeces from the space inside the bowl towards the lower chamber.

4. A toilet as claimed in claim 3, in which the central opening provided on the closing wall between the bowl and the lower chamber, is occupied by a diaphragm constituted by a film of supple material such as rubber and provided with radial slots joining up in the center, said slots defining V-shaped lips which can move apart under the dynamic pressure of the liquid flow and return elastically to a closed position, said diaphragm constituting a screen which stops sound vibrations from passing from the lower chamber into the inside of the bowl.

5. A toilet as claimed in claim 1, wherein the crushing and draining means are constituted on the one hand by a rotor which is removably mounted on the spindle of a fixed motor and on the other hand by a stator formed by a cylindrical skirt removably mounted inside said lower chamber.

6. A toilet as claimed in claim 5, in which the lower chamber is constituted by a casing of general cylindrical shape, wherein said casing contains on the inside said cylindrical skirt concentric to said casing, the base of said skirt extending downwards to the level of the rotor, a small clearance being provided to allow the rotation of said rotor, which is equipped on its periphery with radial vanes disposed externally with respect to the wall of the skirt, said skirt and rotor being provided with perforations thus forming a filtering basket preventing foreign substances from being carried from the inside of the lower chamber towards the draining conduit.

7. A toilet as claimed in claim 6, wherein the perforations provided in the wall of said skirt and on the wall of said rotor are constituted by slashes made in said walls, and bent inwardly, said slashes constituting asperities and forming a rasp capable of speeding up the reduction and laceration of the faeces contained in the lower chamber.

8. A toilet as claimed in claim 6, wherein said skirt, which is concentric to the casing, is integral with the closing wall occupying the passage between the bottom of the bowl and the crushing chamber.

9. A toilet as claimed in claim 6, in which the motor driving the rotor is mounted vertically; the driving spindle being situated vertically upwards with the bottom of the casing and traversing said bottom, whilst sealing means overlap the bottom and are interposed around said spindle, the motor and casing are forcibly locked in position by at least a screw forming height-adjusting jack inserted between a horizontal base of the toilet and the bottom part of the motor, the casing-motor being thus locked in position, whilst remaining easily dismountable by untightening the screw.

* * * * *